US006769435B2

(12) United States Patent
Dall'Osso et al.

(10) Patent No.: US 6,769,435 B2
(45) Date of Patent: Aug. 3, 2004

(54) CIGARETTE MAKER OUTFEED UNIT

(75) Inventors: Davide Dall'Osso, Bologna (IT); Massimo Sartoni, Bologna (IT); Fulvio Boldrini, Ferrara (IT)

(73) Assignee: G. D S.p.A., Bologna (IT)

( * ) Notice: Subject to any disclaimer, the term of this patent is extended or adjusted under 35 U.S.C. 154(b) by 0 days.

(21) Appl. No.: 10/262,069

(22) Filed: Oct. 2, 2002

(65) Prior Publication Data

US 2003/0062054 A1 Apr. 3, 2003

(30) Foreign Application Priority Data

Oct. 3, 2001 (IT) ..... BO2001A0604

(51) Int. Cl.[7] ..... A24C 5/12
(52) U.S. Cl. ..... 131/65; 131/84.1
(58) Field of Search ..... 131/84.1, 91, 84.4, 131/77, 83.1, 65

(56) References Cited

U.S. PATENT DOCUMENTS 4,188,957 A * 2/1980 Legardinier ..... 131/96
4,406,293 A * 9/1983 Maldina ..... 131/84.1

FOREIGN PATENT DOCUMENTS

DE 2626080 * 12/1976

* cited by examiner

*Primary Examiner*—Dionne A. Walls
(74) *Attorney, Agent, or Firm*—Davidson Berquist Klima & Jackson, LLP

(57) ABSTRACT

The outfeed unit of a cigarette maker establishes a feed path along which at least one cigarette rod is caused to advance in a predetermined direction from the outfeed end of a beam, on which the rod is formed, toward a cutter device by which the rod is divided into sticks constituting single cigarettes; the unit is equipped with a cut-off device located in close proximity to the outfeed of the forming beam, by which the rod is severed and diverted from the feed path, and, at a given point downstream of the cut-off device, with pinch rollers by which a portion of the rod separated through the action of the cut-off device is removed from a final stretch of the feed path between the cut-off device and the cutter device.

13 Claims, 4 Drawing Sheets

CIGARETTE MAKER OUTFEED UNIT

BACKGROUND OF THE INVENTION

The present invention relates to an outfeed unit in a cigarette maker.

Machines for making cigarettes comprise a unit serving to shape and advance a continuous ribbon of tobacco filler drawn from a tobacco feeder device, and a unit serving to feed a continuous strip of paper which is directed onto and along a forming beam and wrapped progressively around the ribbon of tobacco filler to form a continuous cigarette rod. On reaching an outfeed unit of the machine, the cigarette rod is advanced along a predetermined feed path at a predetermined speed, passing through a succession of quality control devices and into a cutting station where it is divided into cigarette sticks of predetermined length by a rotary cutter device.

Conventionally, when the machine is started and stopped, and in certain circumstances during normal operation, the need may arise to activate a cut-off device located between the beam and the quality control devices, in order to separate a portion of the cigarette rod and divert it from the feed path toward a reject station.

The cut-off device in question is interlocked to the aforementioned quality control devices and will be activated in the event of the selfsame devices detecting properties or defects in the cigarette rod such as render it unsuitable for the production of single cigarettes.

Following the operation of the cut-off device, the length of cigarette rod remaining between the selfsame cut-off device and the rotary cutter must be removed manually so that normal operation of the machine can be resumed. The task of removing this fragment of cigarette rod is a complex one, since besides opening up the casing of the machine it may also be necessary to disturb the quality control devices, dismantling them in part and occasioning lengthy periods of inactivity as a result.

The object of the present invention is to provide an outfeed unit for a cigarette maker such as will be unaffected by the aforementioned drawbacks.

SUMMARY OF THE INVENTION

The stated object is duly realized according to the present invention in a cigarette maker outfeed unit comprising a feed path along which at least one cigarette rod is advanced in a predetermined direction, extending between the outfeed end of a beam on which the cigarette rod is formed and a cutter device by which the continuous cigarette rod is divided into discrete sticks constituting single cigarettes, also a cut-off device positioned in close proximity to the forming beam and capable of movement between a position of disengagement from the feed path, and a position of interference with the selfsame path in which the rod is cut and diverted from the path, characterized in that it comprises removal means by which a portion of the continuous cigarette rod separated through the action of the cut-off device is distanced from a final stretch of the feed path extending between the cut-off device and the cutter device.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
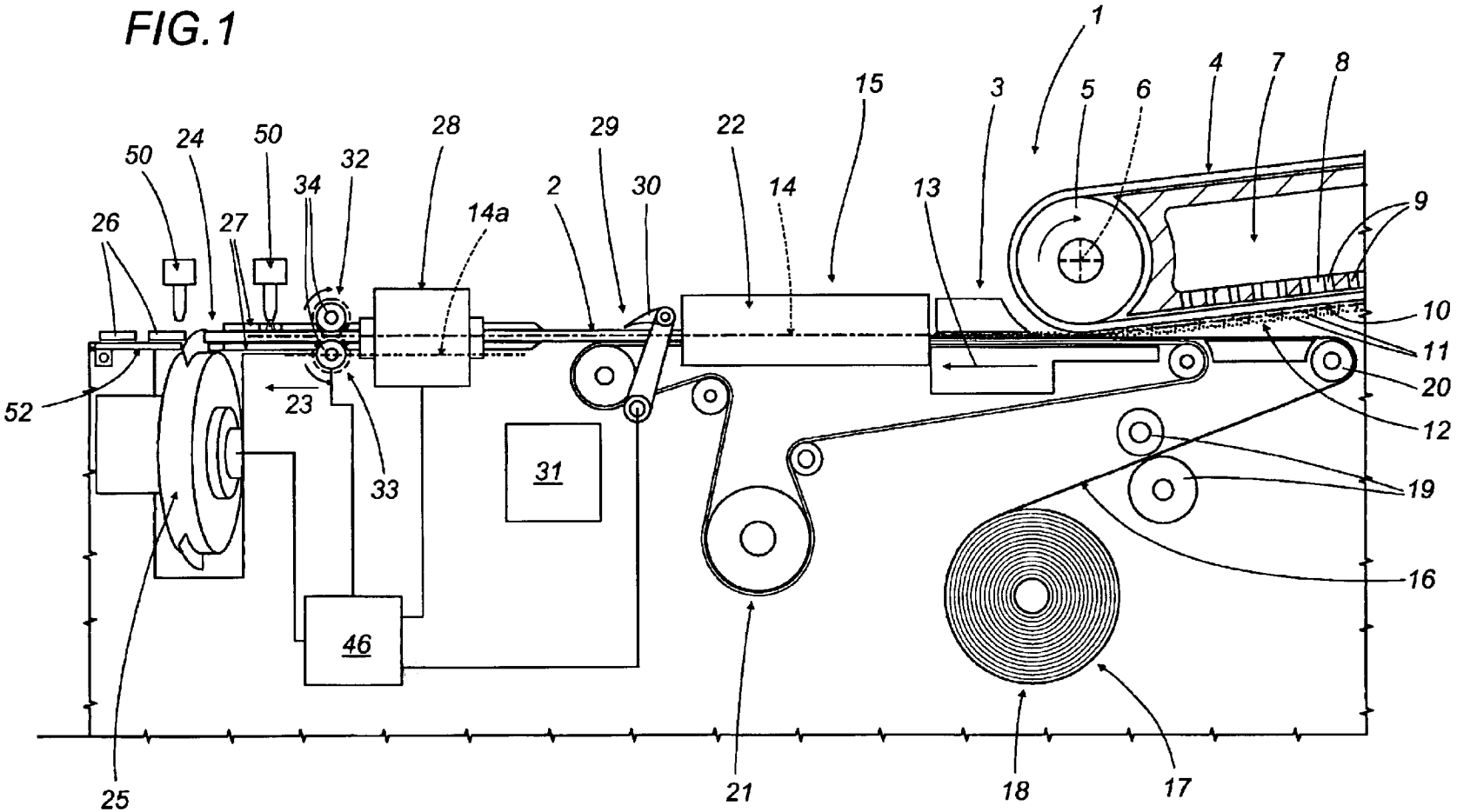
FIG. 1 shows an outfeed unit of a cigarette maker, embodied in accordance with the present invention, viewed schematically in a side elevation with certain parts in section and others omitted for clarity.

Referring to FIG. 1 of the drawings, 1 denotes a portion, in its entirety, of a machine serving to fashion a continuous cigarette rod 2. The machine 1 is equipped with an outfeed unit denoted 3 in its entirety, which comprises an aspirating conveyor belt 4 looped around two pulleys 5 positioned one at either end (one only of which is illustrated in FIG. 1) and rotatable clockwise, as viewed in the drawing, about mutually parallel horizontal axes 6. The endless loop described by the conveyor belt 4 compasses a chamber 7 connected to a source of negative pressure (not illustrated) and delimited at the bottom by a wall 8 pierced with suction holes 9. As discernible in FIG. 1, the bottom branch 10 of the conveyor belt 4 runs in sliding contact with the wall 8 and is able to retain the particles 11 of tobacco by suction as they emerge from a riser (not illustrated) located beneath the branch 10, thus forming a continuous ribbon 12 of tobacco.

The ribbon 12 is directed by the branch 10 of the belt 4 in a substantially horizontal direction 13, transverse to the axis 6 of the pulley 5, onto a feed path 14 running through a station 15 at which the continuous cigarette rod 2 is formed.

The forming station 15 is occupied by a running strip 16 of paper, directed along the feed path 14, which is decoiled by a relative feeder unit 17 from a roll 18 through the action of a pair of pinch wheels 19. The decoiling strip 16 is taken around a pulley 20 and routed toward the forming station 15, which incorporates a belt conveyor 21 capable of retaining the strip 16 of paper by suction and advancing it along the feed path 14 together with the ribbon 12 of tobacco filler released onto the strip 16 by the bottom branch 10 of the conveyor belt 4.

The forming station 15 also comprises a beam 22 of conventional embodiment extending along the feed path 14, of which the function is to wrap the paper strip 16 around the ribbon 12 of tobacco filler. The two longitudinal edges of the strip 16 are overlapped gradually along the beam 22 and glued together (in a conventional manner not indicated), thereby generating the aforementioned continuous cigarette rod 2.

The feed path 14 extends beyond the beam 22 and along a feed direction 23 followed by the rod 2 toward a cutting station 24, at which a rotating cutter device 25 divides the continuous rod 2 into discrete cigarette sticks 26 of predetermined and constant length.

The feed path 14 presents a final stretch 14*a* between the beam 22 and the cutting station 24, coinciding with a table 27 along which the rod 2 is guided, and including a quality control device 28 by which the cigarette rod 2 is scanned in order to verify that it is correctly formed, and to reveal any possible defects. Also located between the quality control device 28 and the outfeed end of the beam 22 is a cut-off device 29 comprising a blade 30 capable of movement between a raised first position of disengagement from the feed path 14*a*, illustrated in FIG. 1, and a second position of interference with the feed path 14, illustrated in FIG. 2, in which the cigarette rod 2 is diverted by the device 29 toward a reject station 31, having been cut during the passage of the blade from the first to the second position. The cut-off device 29 can come into operation either when the machine 1 is started up and shut down, or whenever a defect is detected in the cigarette rod 2 by the quality control device 28, to which the cut-off device 29 is interlocked.

Figure 2:
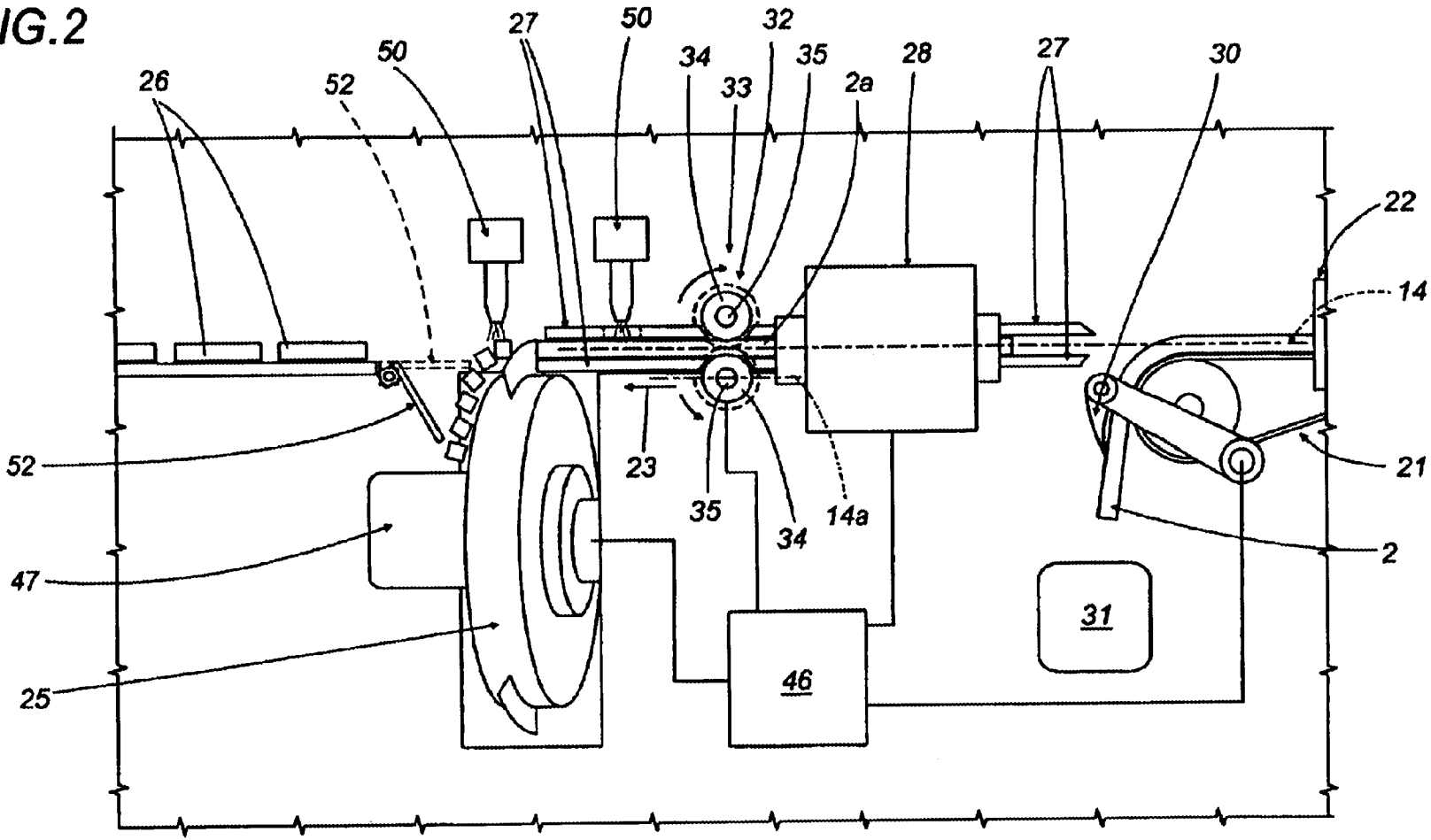
FIG. 2 is an enlarged detail of FIG. 1, viewed schematically in a side elevation and with certain parts omitted for clarity.

Referring to FIG. 1 and FIG. 2, the outfeed unit 3 further comprises means 32, located between the cutting station 24 and the quality control station 28, of which the function is to remove a portion 2*a* of the cigarette rod 2 that may be left on the final stretch 14*a* of the feed path 14, which extends from the cut-off device 29 to the rotary cutter device 25, following the operation of the cut-off device 29.

Figure 5:
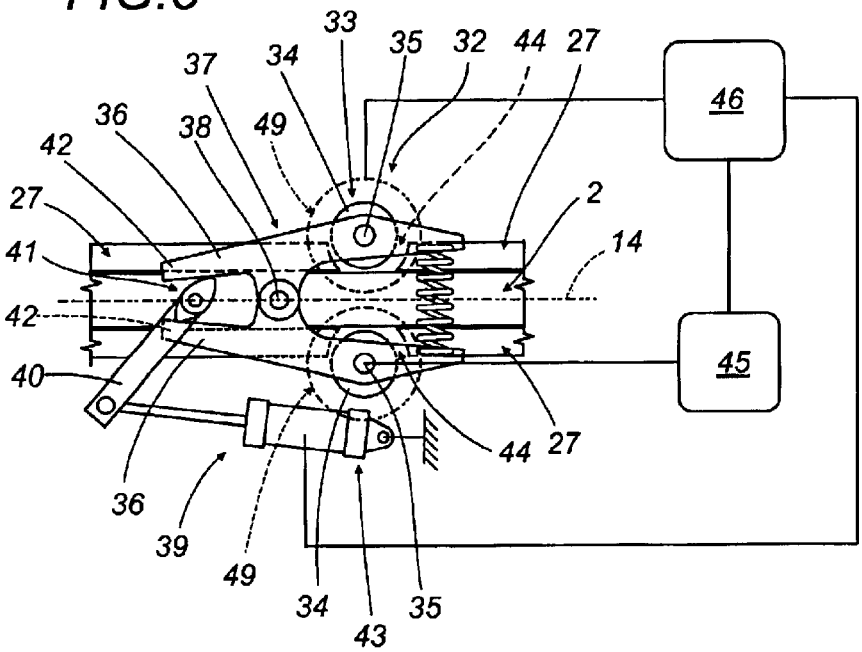
Figure 6:
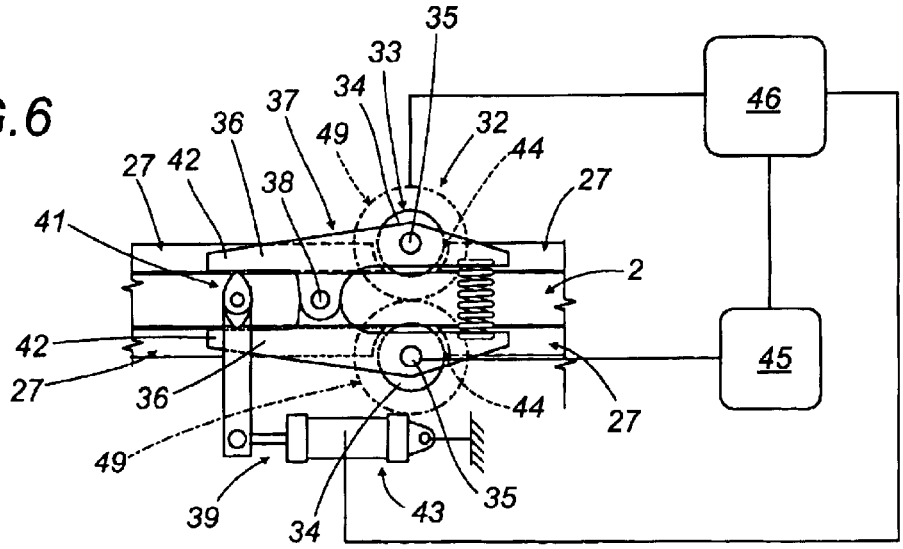
FIG. 6 illustrates the detail of FIG. 5 in a different operating position.

Observing FIGS. 2, 5 and 6 it will be seen that the removal means 32 comprise gripping and feeding means 33 by which the aforementioned portion 2*a* of cigarette rod 2 is taken up and advanced along the final stretch 14*a* of the feed path 14.

The gripping and feeding means 33 comprise a pair of rollers 34 positioned one on either side of the final stretch 14*a* of the feed path 14 and mounted to respective mutually parallel shafts 35 extending transversely to the path 14.

In the example of FIGS. 5 and 6, the rollers 34 are mounted to respective shafts 35 carried in turn by the jaws 36 of a gripper 37 centered on a pivot denoted 38.

The gripper 37 is operated by respective drive means 39 comprising a lever 40 of which one end carries a pair of cams 41 acting on the gripper 37 by engagement with the free ends 42 of the jaws 36, on either side of the pivot 38. The remaining end of the lever 40 is connected to relative actuator means 43, consisting in a cylinder, by which the jaws 36 are opened and closed through the agency of the lever 40, the cams 41 and the free ends 42. The rollers 34 are rendered capable thus of movement between a first non-operating position spread apart as illustrated in FIG. 5, and a second operating position, drawn together as illustrated in 6, in which they combine to create a passage coinciding with a break 44 in the table 27 and presenting a transverse dimension substantially equal to the transverse dimension of the cigarette rod 2.

The rollers 34 are driven by a motor indicated by a block denoted 45, and set in rotation in opposite directions so that the portion 2*a* of the cigarette rod 2 is caused to advance in the aforementioned direction 23 toward the rotary cutter device 25. In particular, the gripper actuator 43, the motor 45 and cutter device 25 are interlocked to a master control unit 46 which in turn is connected to the quality control device 28. On receiving a signal from the quality control device 28, the unit 46 will pilot the actuator 43 to draw the rollers 34 closer together and activate the motor 45 to set them in rotation about the respective shafts 35, while causing the cutter device 25 (in the example of FIG. 2) to rotate at a prescribed frequency generally higher than during normal operation so as to chop up the portion 2*a* of the cigarette rod 2 advanced toward the device 25 by the rollers 34.

The fragments of cigarette rod thus produced are diverted toward a reject station, indicated as a block denoted 47, by means of a movable flap 52 forming part of the table 27 and able to pivot about an axis transverse to the feed path 14, between a raised position of substantial alignment with the plane occupied by the table 27 (FIG. 1) and a lowered position (FIG. 2) in which the fragments of cigarette rod are diverted away.

Figure 3:
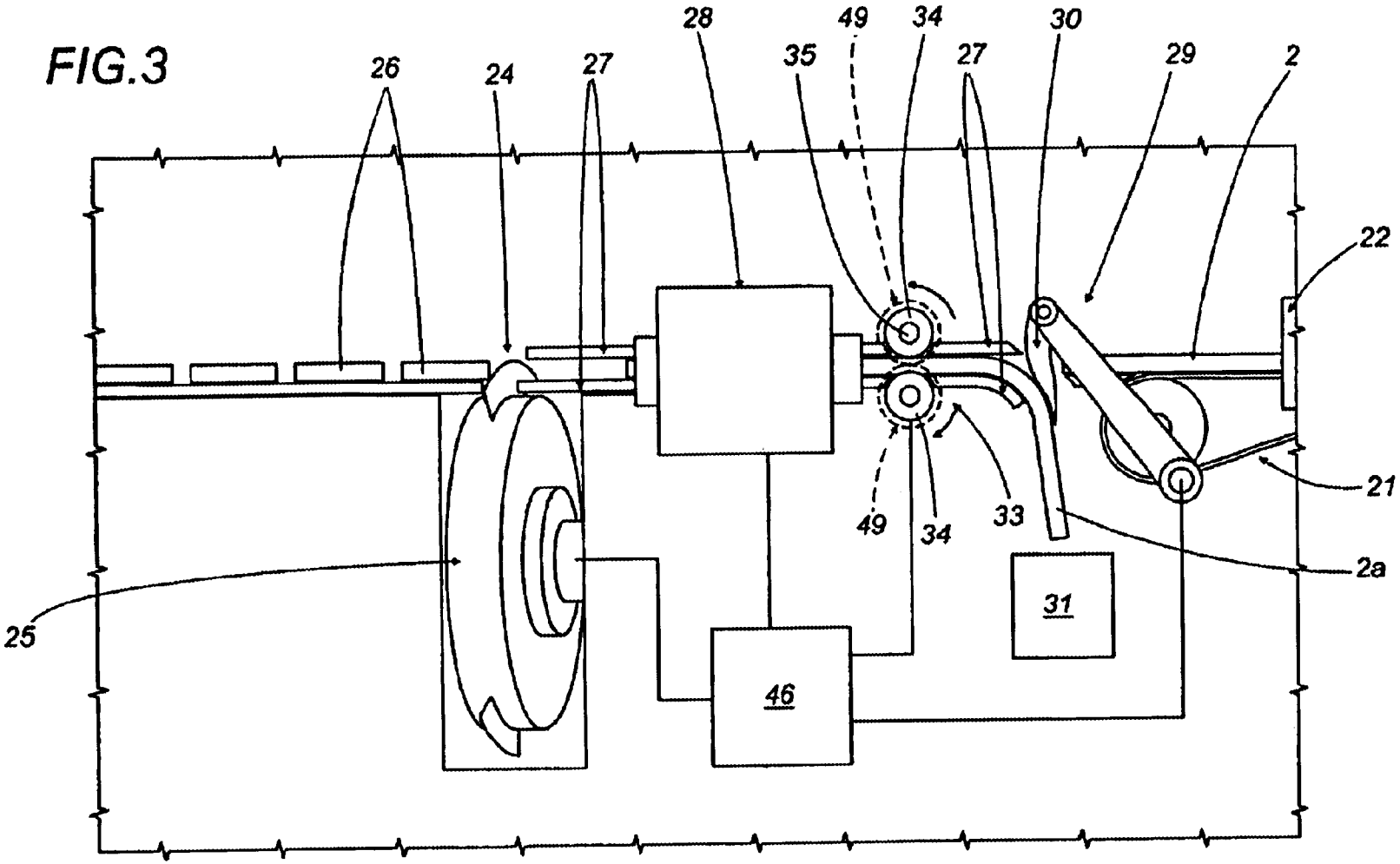
FIG. 3 shows the enlarged detail of FIG. 2 in a second possible embodiment, viewed schematically in a side elevation and with certain parts omitted for clarity.

In an alternative embodiment of the unit shown in FIG. 3, the rollers 34 are located between the cut-off blade 30 and the quality control device 28, rather than beyond this self-same device 28.

In this instance the motor 45 will be piloted to rotate the rollers 34 in the direction opposite to that described previously, so that the portion 2*a* of cigarette rod 2 is taken up and advanced along the final stretch 14*a* of the feed path 14 in the direction opposite to the predetermined direction denoted 23 toward the cut-off device 29, which will then divert the portion 2*a* of rod toward the reject station 31. In particular, the surface 29*a* of the cut-off device 29 directed toward the rollers 34 is fashioned in such a way as to provide an effective diverting element by means of which to guide the portion 2*a* of rod 2 toward the reject station 31.

Figure 4:
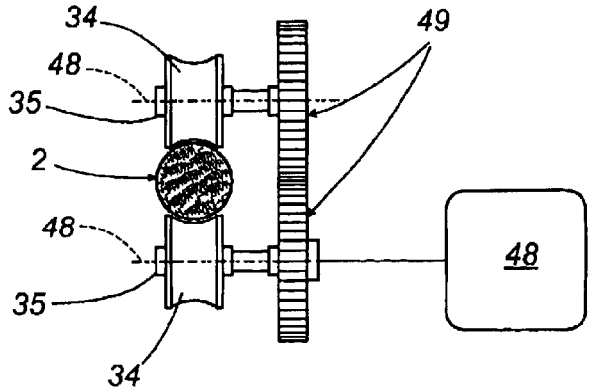
FIGS. 4 and 5 show a detail of the unit as in FIG. 1 illustrated in two different embodiments, viewed schematically in front elevation and side elevation, respectively, and with certain parts omitted for clarity.

In the example of FIG. 4, the two rollers 34 of the gripping and feeding means 33 are mounted to respective shafts 35 with respective fixed parallel axes 48 by which the rollers are carried in a fixed position, corresponding to the operating position described previously, and in which they combine to create a passage coinciding with a break 44 in the table 27 and presenting a transverse dimension substantially equal to the transverse dimension of the cigarette rod 2. In this instance the motor 4 is coupled to a pair of gear wheels 49, engaged in constant mesh, which during normal operation of the machine 1 will drive the rollers 34 at a tangential velocity identical to the linear velocity of the advancing rod 2.

In both the embodiments illustrated in FIGS. 4 and 5, the surface of revolution presented by each of the rollers 34 and engaging in contact with the cigarette rod presents a cross-section of U-shaped profile, and the gear wheels 49 and the motor 45 are included in both the solutions indicated (see FIGS. 4, 5 and 6). To advantage, as illustrated in FIGS. 1 and 2, the unit comprises pneumatic means 50 located along the final stretch 14*a* of the feed path 14, by which a flow of pressurized air can be directed along the path 14 to eliminate any residual paper and tobacco filler.

Importantly, the outfeed unit 3 described above might incorporate any number of variations without straying from the spirit of the present invention. For example, the shafts 35 of the rollers 34 can be oriented in any given direction, provided they are disposed transversely to the feed path 14.

Finally, in the event that the cigarette maker is of a type designed to fashion two cigarette rods simultaneously, the relative outfeed unit, embodied in accordance with the invention, will include a pair of rollers 34 for each one of the two rods.

What is claimed is:

1. A cigarette maker outfeed unit, comprising:

a feed path along which at least one cigarette rod is caused to advance in a predetermined direction, extending between the outfeed end of a beam on which the cigarette rod is formed and a cutter device by which the continuous cigarette rod is divided into discrete sticks constituting single cigarettes;

a cut-off device positioned in close proximity to the forming beam and capable of movement between a position of disengagement from the feed path, and a position of interference with the selfsame path in which the rod is cut and diverted from the path;

removal means by which a portion of the continuous cigarette rod separated through the action of the cut-off device is distanced from a final stretch of the feed path extending between the cut-off device and the cutter device, wherein the removal means comprise gripping and feeding means by which the portion of cigarette rod is taken up and advanced along the final stretch of the feed path.

2. A unit as in claim 1, wherein the gripping and feeding means are designed to direct the portion of cigarette rod in the predetermined direction toward the cutter device, operating in conjunction with the selfsame cutter device to remove the portion of cigarette rod from the final stretch of the feed path.

3. A unit as in claim 2, wherein the gripping and feeding means are interlocked to master control means such as will pilot the selfsame gripping and feeding means to operate at a predetermined feed velocity.

4. A unit as in claim 1, wherein the gripping and feeding means are designed to advance the portion of cigarette rod along the final stretch of the feed path in a direction opposite to the predetermined direction and toward the cut-off device, operating in conjunction with the cutter device to remove the portion of cigarette rod from the final stretch of the feed path and divert it toward a reject station.

5. A unit as in claim 1, wherein the gripping and feeding means comprise two contrarotating rollers disposed on opposite sides of the feed path and mounted to respective shafts of which the axes extend transversely to the selfsame feed path.

6. A unit as in claim 5, wherein the two rollers occupy fixed positions in which they combine to afford a passage presenting a transverse dimension substantially equal to the transverse dimension of the cigarette rod, and are caused to rotate at least during normal operation of the cigarette maker at a tangential velocity substantially identical to the linear velocity of the cigarette rod advancing along the feed path.

7. A unit as in claim 5, wherein the two rollers are capable of movement between a non-operating position, spread apart, and an operating position, drawn closer together, in which they combine to afford a passage presenting a transverse dimension substantially equal to the transverse dimension of the cigarette rod.

8. A unit as in claim 7, wherein the rollers are mounted to respective shafts carried by the jaws of a gripper operated though the agency of mean serving to open and close the jaws, which are set in motion by relative actuator means interlocked to master control means.

9. A unit as in claim 5, wherein a surface of revolution presented by each of the rollers and offered in contact to the cigarette rod presents a cross section of U-shaped profile.

10. A unit as in claim 2, wherein the gripping and feeding means and the cutter device are interlocked to master control means by which the gripping and feeding means are made to operate at a predetermined feed velocity and the cutter device is driven at a predetermined cutting frequency.

11. A unit as in claim 6, wherein a surface of revolution presented by each of the rollers and offered in contact to the cigarette rod presents a cross section of U-shaped profile.

12. A unit as in claim 7, wherein a surface of revolution presented by each of the rollers and offered in contact to the cigarette rod presents a cross section of U-shaped profile.

13. A unit as in claim 8, wherein a surface of revolution presented by each of the rollers and offered in contact to the cigarette rod presents a cross section of U-shaped profile.

* * * * *